US009664491B2

(12) United States Patent
DeVries et al.

(10) Patent No.: US 9,664,491 B2
(45) **Date of Patent: *May 30, 2017**

(54) CONNECTORS FOR SEPARABLE FIRING UNIT ASSEMBLIES, FIRING UNIT ASSEMBLIES AND RELATED METHODS

(71) Applicant: Orbital ATK, Inc., Dulles, VA (US)

(72) Inventors: Derek R DeVries, Farr West, UT (US); Brent D. Madsen, Providence, UT (US); Eldon C. Peterson, North Logan, UT (US); Donald L. Jackson, West Jordan, UT (US); William W. Thorup, West Jordan, UT (US)

(73) Assignee: Orbital ATK, Inc., Plymouth, MN (US)

( * ) Notice: Subject to any disclaimer, the term of this patent is extended or adjusted under 35 U.S.C. 154(b) by 68 days.

This patent is subject to a terminal disclaimer.

(21) Appl. No.: 14/519,748

(22) Filed: Oct. 21, 2014

(65) Prior Publication Data

US 2015/0285606 A1 Oct. 8, 2015

Related U.S. Application Data

(62) Division of application No. 13/348,485, filed on Jan. 11, 2012, now Pat. No. 8,863,665.

(51) Int. Cl.
*F42C 19/12* (2006.01)
*F42C 19/06* (2006.01)
(Continued)

(52) U.S. Cl.
CPC ..... *F42C 19/12* (2013.01); *F41A 19/69* (2013.01); *F42C 19/06* (2013.01); *F42D 1/045* (2013.01);
(Continued)

(58) Field of Classification Search
CPC ..... F42C 19/06; F42C 19/12; F42C 19/0815; F41A 19/69; F42D 1/05; F42D 1/04;
(Continued)

(56) References Cited

U.S. PATENT DOCUMENTS 4,291,623 A 9/1981 Robinson et al.
4,319,526 A 3/1982 DerMott
(Continued)

FOREIGN PATENT DOCUMENTS

CA 2132148 3/1996
WO 0033424 6/2000

*Primary Examiner* — James S Bergin
(74) *Attorney, Agent, or Firm* — TraskBritt

(57) ABSTRACT

Connection cables for separable firing unit assemblies comprise a first mating connector at a first end and a second mating connector at a second, opposing end. A stripline cable electrically connects the first mating connector to the second mating connector. Separable firing unit assemblies comprise an initiation device. An electronics assembly is configured to transmit a firing pulse to the initiation device. One of a first mating connector and a second mating connector is coupled to the initiation device and the other of the first mating connector and the second mating connector is coupled to the electronics assembly. A second housing of the second mating connector is configured to receive a portion of a first housing of the first mating connector therein.

20 Claims, 8 Drawing Sheets

(51) Int. Cl.
*F41A 19/69* (2006.01)
*F42D 1/045* (2006.01)

(52) U.S. Cl.
CPC .... *Y10T 29/49174* (2015.01); *Y10T 29/49208* (2015.01)

(58) Field of Classification Search
CPC ... F42D 1/045; F42B 3/10; C06C 5/06; Y10T 29/49208; Y10T 29/49174
USPC .. 102/200, 202.12, 202.14, 202.9, 206, 215, 102/275.2, 245.4, 275.6, 275.7, 275.11; 361/247, 248, 249
See application file for complete search history.

(56) References Cited

U.S. PATENT DOCUMENTS 4,655,139 A 4/1987 Wilhelm
4,658,727 A 4/1987 Wilhelm et al.
4,739,709 A 4/1988 Zimmerschied
4,781,117 A 11/1988 Garnett et al.
4,823,701 A 4/1989 Wilhelm
4,848,239 A 7/1989 Wilhelm
5,831,203 A 11/1998 Ewick
5,969,286 A 10/1999 Ward et al.
6,070,531 A 6/2000 Hansen et al.
6,082,264 A * 7/2000 Meyer ..... F42D 1/043 102/202.5
6,146,598 A 11/2000 Duvacquier et al.
6,158,347 A 12/2000 Neyer et al.
6,178,888 B1 1/2001 Neyer et al.
6,230,625 B1 5/2001 Neyer et al.
6,234,081 B1 5/2001 Neyer
6,318,268 B1 11/2001 Maehata et al.
6,470,802 B1 10/2002 Neyer et al.
6,502,512 B2 1/2003 Riviere et al.
6,513,436 B2 2/2003 Bernard et al.
6,732,655 B1 5/2004 Jakob et al.
6,851,370 B2 2/2005 Reynolds et al.
6,992,877 B2 1/2006 DeVries et al.
7,192,054 B2 3/2007 Smith
7,261,028 B2 8/2007 Devries et al.
7,301,750 B2 11/2007 DeVries et al.
7,343,859 B2 3/2008 Matsuda et al.
7,571,679 B2 8/2009 Nance
7,690,303 B2 4/2010 Reynolds et al.
7,698,982 B2 4/2010 Bell
7,748,322 B1 7/2010 Reynolds et al.
8,408,132 B2 4/2013 Lucas et al.
8,573,124 B2 * 11/2013 Havran ..... F42C 15/40 102/202.14
8,661,978 B2 * 3/2014 Backhus ..... F42B 3/121 102/200
8,863,665 B2 * 10/2014 DeVries ..... F41A 19/69 102/202.12
2002/0152913 A1 * 10/2002 Bernard ..... F42B 3/121 102/304
2011/0277620 A1 11/2011 Havran et al.

* cited by examiner

CONNECTORS FOR SEPARABLE FIRING UNIT ASSEMBLIES, FIRING UNIT ASSEMBLIES AND RELATED METHODS

CROSS-REFERENCE TO RELATED APPLICATION

This application is a divisional of U.S. patent application Ser. No. 13/348,485, filed Jan. 11, 2012, now U.S. Pat. No. 8,863,665, issued Oct. 21, 2014, the disclosure of which is hereby incorporated herein in its entirety by this reference.

FIELD

The disclosure relates generally to firing unit assemblies for munitions systems. More specifically, disclosed embodiments relate to separable firing unit assemblies including connectors that enable initiation devices to be safely and easily removed from electronics assemblies.

BACKGROUND

There are many applications in which a firing unit is utilized to initiate or detonate explosive or pyrotechnic materials for actuation or detonation of a device or system. Examples include such things as weapon systems, aerospace systems such as rocket motors, airbag initiators, parachute harness connectors, and other systems. Firing units utilized in weapon systems, aerospace systems, and other systems typically include an electronics assembly and an initiation device. Such explosive or pyrotechnic materials may be ignited in several different ways. Typically, explosive materials have been ignited by flame ignition (e.g., fuzes or ignition of a priming explosive), impact (which often ignites a priming explosive), chemical interaction (e.g., contact with a reactive or activating fluid), or electrical ignition. Electrical ignition may occur in at least two distinct ways: by ignition of a priming material (e.g., electrically ignited blasting cap or priming material) or by direct energizing of an explosive mass by electrical power. A firing unit may include an explosive material secured within a housing, an initiation device configured to ignite the explosive material, and to an electronics assembly electrically connected to the initiation device. The firing unit may be inserted into a system containing ignitable material to be activated or detonated (e.g., rocket fuel, primary explosive, booster charge, or ignitable compositions). When the electronics assembly in the firing unit is activated, the electronics assembly activates the initiation device, which causes ignition of the explosive material.

Generally, the electronics assembly and the initiation device of a firing unit are assembled together such that the initiation device may not be nondestructively removed from the electronic assembly or, in some instances, may be configured such that the initiation device is separable from the electronic assembly. However, the separability of the firing unit may be undesirable in some instances because the ability to remove the electronics assembly from the initiation device may compromise or deteriorate the electronic connections between the firing unit and the initiation device. For example, use of a separable electrical connection between the electronics assembly and the initiation device may increase the inductance of the firing circuit. An increase in the inductance of a firing circuit may be undesirable in such systems employing a high voltage firing unit (HVFU). For example, an initiation device such as an exploding foil initiator (EFI) may require a relatively large amount of voltage and current from the electronics assembly to ignite the EFI. Increasing the inductance of the firing circuit may compromise the ability of the electronics assembly to reliably ignite the EFI, decreasing the reliability and safety of the firing unit.

Furthermore, a separable electrical connection between the electronics assembly and the initiation device may compromise the ability of the firing unit to be sealed from a surrounding environment in certain applications where such a seal is desirable. Finally, a separable electrical connection between the electronics assembly and the initiation device may undesirably increase any, some, or all of size, weight, and cost of the firing unit, which may be especially undesirable where the firing unit is implemented in systems utilized in aerospace flight.

BRIEF SUMMARY

In some embodiments, connection cables for separable firing unit assemblies comprise a first mating connector configured for removable connection to an initiation device at a first end. A second mating connector is configured for removable connection to an electronics assembly at a second, opposing end. A stripline cable electrically connects the first mating connector to the second mating connector.

In other embodiments, separable firing unit assemblies comprise an initiation device configured to ignite a material. An electronics assembly is configured to transmit a firing pulse to the initiation device. A first mating connector comprises a first housing and a first electrical interface disposed at least partially within a first recess defined by a portion of the first housing. A second mating connector is configured for removable connection to the first mating connector, the second mating connector comprising a second housing and a second electrical interface disposed at least partially within a second recess defined by a portion of the second housing. One of the first mating connector and the second mating connector is coupled to the initiation device and the other of the first mating connector and the second mating connector is coupled to the electronics assembly. The second housing of the second mating connector is configured to receive a portion of the first housing of the first mating connector therein.

In still other embodiments, separable firing unit assemblies comprise an initiation device configured to ignite a material and comprising a first mating connector comprising a first housing and a first electrical interface disposed at least partially within a first recess defined by a portion of the first housing. An electronics assembly is configured to transmit a firing pulse to the initiation device and comprises a second mating connector configured for removable connection to the first mating connector. The second mating connector comprises a second housing and a second electrical interface disposed at least partially within a second recess defined by a portion of the second housing. The first mating connector of the initiation device and the second mating connector of the electronic assembly are configured to form an electrical connection between the first electrical interface and the second electrical interface when a portion of the first mating connector is cooperatively engaged with a portion of the second mating connector.

In yet other embodiments, methods of forming firing unit assemblies comprise forming a first mating connector on an initiation device configured to ignite an explosive material. A second mating connector on an electronics assembly, which is configured to transmit a firing pulse to the initiation device, is formed. Such forming acts comprise disposing a first electrical connection at least partially within a first recess formed in the first mating connector. A second electrical connection is disposed at least partially within a second recess formed in the second mating connector. The first electrical connection and the second electrical connection are configured to form an electrical connection therebetween when a portion of the first mating connector is cooperatively engaged with a portion of the second mating connector.

BRIEF DESCRIPTION OF THE DRAWINGS

While the specification concludes with claims particularly pointing out and distinctly claiming what are regarded as embodiments of the disclosure, various features and advantages of disclosed embodiments may be more readily ascertained from the following description when read in conjunction with the accompanying drawings, in which:

DETAILED DESCRIPTION

The illustrations presented herein are not meant to be actual views of any particular connector, firing unit assembly, or component thereof, but are merely idealized representations employed to describe illustrative embodiments. Thus, the drawings are not necessarily to scale and relative dimensions may have been exaggerated or understated for the sake of clarity. Additionally, elements common between figures may retain the same or similar numerical designation.

Disclosed embodiments relate generally to separable firing unit assemblies including connectors that enable initiation devices to be removed from electronics assemblies. More specifically, disclosed are connectors for connecting initiation devices to electronic assemblies that enable disconnection of the initiation devices from the electronics assemblies and do not significantly degrade a firing pulse transmitted through the connectors.

Firing unit assemblies may be integrated or utilized with various types of devices including an ignitable fuel such as, for example, explosive devices (e.g., ground and aerial ordnance) and propulsion systems utilized in airframes including rockets, satellites, missiles, launch vehicles, or other such devices where the firing unit assemblies are utilized to initiate various state changes. Such devices may include, but are not limited to, ignition devices, exploding bolts, actuators, gas generators, separation devices, pressure equalization and ventilation devices.

Figure 1:
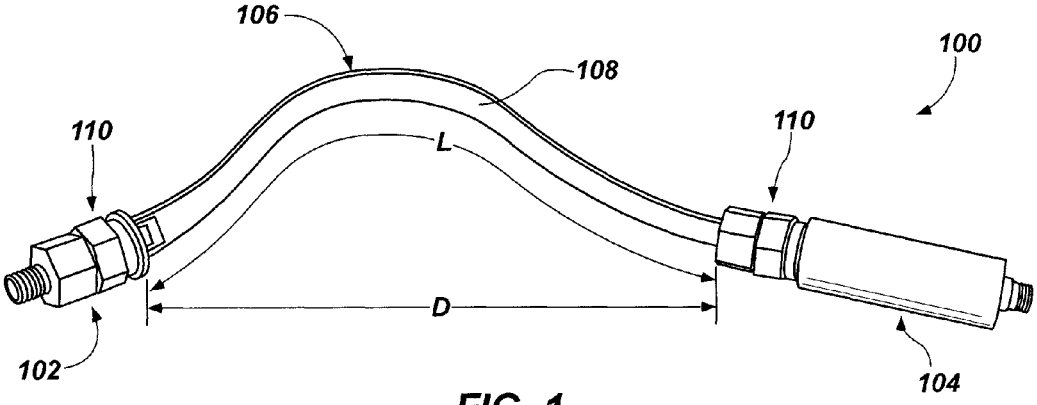
FIG. 1 is a perspective view of a firing unit assembly.

Referring to FIG. 1, a perspective view of a firing unit assembly 100 is shown. The firing unit assembly 100 includes an initiation device 102 configured for igniting a fuel (e.g., an explosive material, a propellant, or other explosive devices and fuels) and an electronics assembly 104 configured to connect with (e.g., directly or indirectly) and transmit a firing pulse to the initiation device 102. In some embodiments, a connection cable 106 may electrically connect the initiation device 102 to the electronics assembly 104. In other embodiments, and as discussed below in greater detail, the initiation device 102 may be directly connected to electronics assembly 104. The connection cable 106 may comprise a stripline cable 108 extending between mating connectors 110 that connect with corresponding mating connectors 110 on the initiation device 102 and the electronics assembly 104. The various mating connectors 110 may be removably connected to one another. In other words, each of the initiation device 102, the electronics assembly 104, and the connection cable 106 may be separable from one another. Such an embodiment may enable a user to separate the components of the firing unit assembly 100 for periodic tests and replacement of any defective components by exchanging with another initiation device 102, electronics assembly 104, or connection cable 106. In other embodiments, the connection cable 106 may be permanently connected to one of the initiation device 102 and the electronics assembly 104 and removably connected to the other of the initiation device 102 and the electronics assembly 104.

A length L of the stripline cable 108 may be sufficiently long to span a distance D between the initiation device 102 and the electronics assembly 104. For example, the length L of the stripline cable 108 may be between 2 inches (5.08 cm) and 36 inches (91.44 cm). As a specific, nonlimiting example, the length L of the stripline cable 108 may be about 18 inches (45.72 cm). In some embodiments, the stripline cable 108 may provide an indirect connection between the initiation device 102 and the electronics assembly 104 allowing separate positioning of the initiation device 102 and the electronics assembly 104 when installed in a device rather than when the initiation device 102 and the electronics assembly 104 are rigidly coupled together (see, e.g., FIG. 3). For example, the distance D between the initiation device 102 and the electronics assembly 104 spanned by the stripline cable 108 may be between 2 inches (5.08 cm) and 36 inches (91.44 cm) when installed in a device. In other embodiments, the distance D between the initiation device 102 and the electronics assembly 104 may be less than the length L of the stripline cable 108. For example, the distance D between the initiation device 102 and the electronics assembly 104 may be between 2 inches (5.08 cm) and 6 inches (15.24 cm) where the length L of the stripline cable 108 is greater than 6 inches (15.24 cm).

The connection cable 106 may enable the initiation device 102 to remain electrically connected to the electronics assembly 104 despite physical separation of the initiation device 102 from the electronics assembly 104. Distancing the electronics assembly 104 from the initiation device 102 may enable the firing unit assembly 100 to be used in applications with limited space and may protect components (e.g., sensitive components) of the electronics assembly 104 from extreme environments. For example, such a firing unit assembly 100 may be employed in applications where pressures may be or may fluctuate within a range from ambient pressure to vacuum pressure, where temperatures may be or may fluctuate within a range from −53.9° C. to 93.3° C., and where extreme mechanical vibrations and mechanical shocks may occur. In some embodiments, a shield braid (not shown) may be disposed around the stripline cable 108 from the first end 112 to the second, opposing end 114 (see FIG. 2) and may be abutted with (e.g., attached to) the third and fourth mating connectors 110C and 110D.

Figure 2:
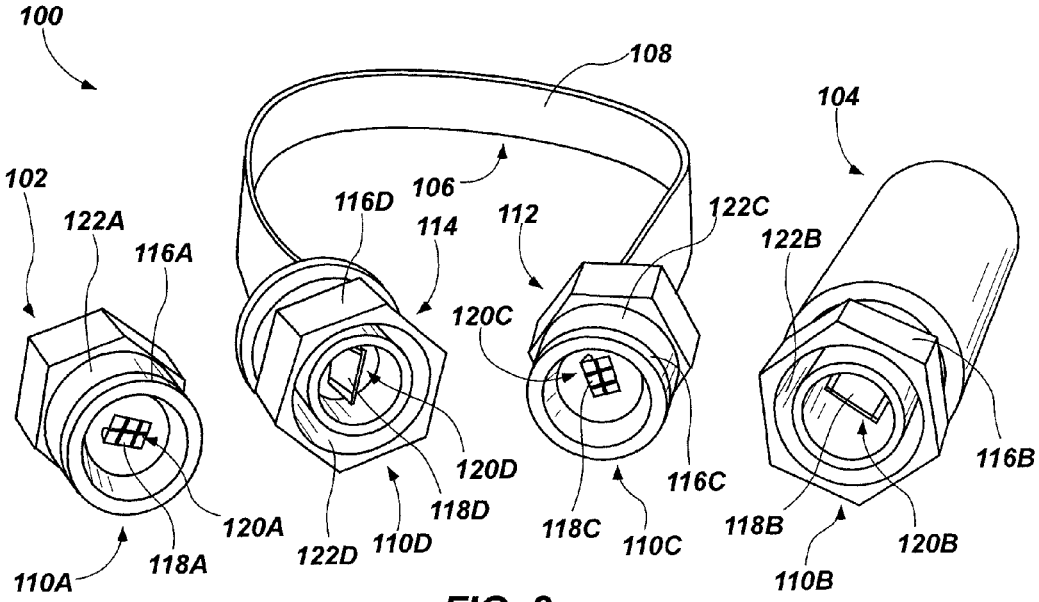
FIG. 2 is a perspective view of disassembled components of the firing unit assembly of FIG. 1.

Referring to FIG. 2, a perspective view of disassembled components of the firing unit assembly 100 of FIG. 1 is shown. As shown in this disassembled state, the initiator device 102 may comprise a first mating connector 110A, the electronics assembly 104 may comprise a second mating connector 110B, and the connection cable 106 may comprise a third mating connector 110C at a first end 112 of the connection cable 106 and a fourth mating connector 110D at a second, opposing end 114 of the connection cable 106.

The first mating connector 110A may comprise a first housing 116A. The first housing 116A may include a first electrical interface 118A disposed at least partially within a first recess 120A defined by the first housing 116A. The first electrical interface 118A may be configured to electrically connect to another electrical interface (e.g., second or fourth electrical interface 118B or 118D of second or fourth housing 116B or 116D). The first housing 116A may further include a first connection portion 122A configured to removably connect to a connection portion of another mating connector (e.g., to second or fourth connection portion 122B or 122D of second or fourth housing 116B or 116D). The first housing 116A may be configured to be at least partially inserted into a housing of another mating connector (e.g., into second or fourth housing 116B or 116D of second or fourth mating connector 110B or 110D).

The second mating connector 110B may comprise a second housing 116B. The second housing 116B may include a second electrical interface 118B disposed at least partially within a second recess 120B defined by the second housing 116B. The second electrical interface 118B may be configured to electrically connect to another electrical interface (e.g., first or third electrical interface 118A or 118C of first or third housing 116A or 116C). The second housing 116B may further include a second connection portion 122B configured to removably connect to a connection portion of another mating connector (e.g., to first or third connection portion 122A or 122C of first or third housing 116A or 116C). The second housing 116B may be configured to receive at least a portion of a housing of another mating connector within the second housing 116B (e.g., receive first or third housing 116A or 116C of first or third mating connector 110A or 110C within the second housing 116B).

The third mating connector 110C may be configured in a manner similar to the first mating connector 110A. Likewise, the fourth mating connector 110D may be configured in a manner similar to the second mating connector 110B. When assembling the firing unit assembly 100 as shown in FIG. 1 and with continued reference to FIG. 2, the first housing 116A of the first mating connector 110A of the initiator device 102 may be at least partially inserted into the fourth housing 116D of the fourth mating connector 110D of the connection cable 106. The first electrical interface 118A of the first mating connector 110A may be electrically connected to the fourth electrical interface 118D of the fourth mating connector 110D. The first connection portion 122A of the first mating connector 110A may be removably connected to the fourth connection portion 122D of the fourth mating connector 110D.

Assembly of the firing unit assembly 100, as shown in FIG. 1, may further include at least partially inserting the third housing 116C of the third mating connector 110C of the connection cable 106 into the second housing 116B of the second mating connector 110B of the electronics assembly 104. The second electrical interface 118B of the second mating connector 110B may be electrically connected to the third electrical interface 118C of the third mating connector 110C. The second connection portion 122B of the second mating connector 110B may be removably connected to the third connection portion 122C of the third mating connector 110C. Upon removably connecting the connection cable 106 to both the initiator device 102 and the electronics assembly 104, the firing unit assembly 100 may be assembled.

In other embodiments, the initiation device 102 may comprise a mating connector configured in a manner similar to the second mating connector 110B and the electronics assembly 104 may comprise a mating connector configured in a manner similar to the first mating connector 110A. In such embodiments, the connection cable 106 may be reversed in orientation to removably connect the initiation device 102 and the electronics assembly 104.

In some embodiments, the initiation device 102 may include one or more detonators or initiators for ignition of fuels that are electrically initiated. As specific, nonlimiting examples, an initiation device 102 may comprise a slapper detonator, an electronic foil initiator (EFI), a low energy electronic foil initiator (LEEFI), an electronic foil detonator (EFD), a blasting cap, an exploding-bridgewire detonator (EBW), an instantaneous electrical detonator (IED), a short period delay detonator (SPD), or a long period delay detonator (LPD).

Electronics assemblies 104 may comprise, for example, electrical devices and assembled electrical components for transmitting a firing signal to an initiation device 102. As specific, nonlimiting examples, an electronic assembly 104 may comprise a high voltage firing unit (HVFU), a capacitive discharge unit (CDU), an oil-filled capacitor, a MYLAR®-foil capacitor, a ceramic capacitor, a Mica-paper capacitor, a polyester capacitor, a polycarbonate capacitor, a polystyrene capacitor, a polypropylene capacitor, a polyethylene capacitor, a tantalum capacitor, a spark gap, a Thyraton, a krypton, a Spryton, an insulated gate bipolar transistor (IGBT) or an array of IGBTs, or a Marx generator.

Figure 3:
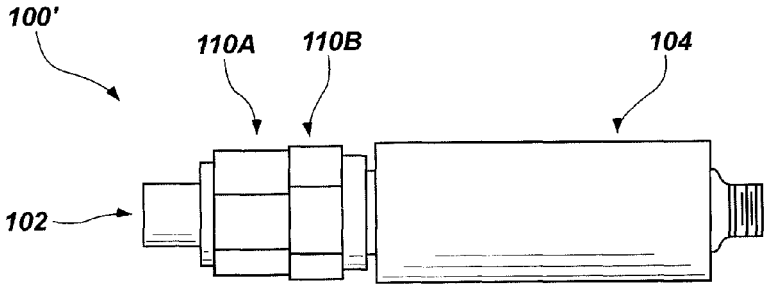
FIG. 3 is a perspective view of another embodiment of a firing unit assembly.

Referring to FIG. 3, a perspective view of another embodiment of a firing unit assembly 100' is shown. The initiation device 102 may be directly and removably connected to the electronics assembly 104. For example, assembling such a firing unit assembly 100' may include at least partially inserting the first housing 116A (see FIG. 2) of the first mating connector 110A of the initiator device 102 into the fourth housing 116D (see FIG. 2) of the second mating connector 110B of the electronics assembly 104. The first electrical interface 118A of the first mating connector 110A may be directly electrically connected to the second electrical interface 118B of the second mating connector 110B. The first connection portion 122A of the first mating connector 110A may be removably connected to the second connection portion 122B of the second mating connector 110B.

Figure 4:
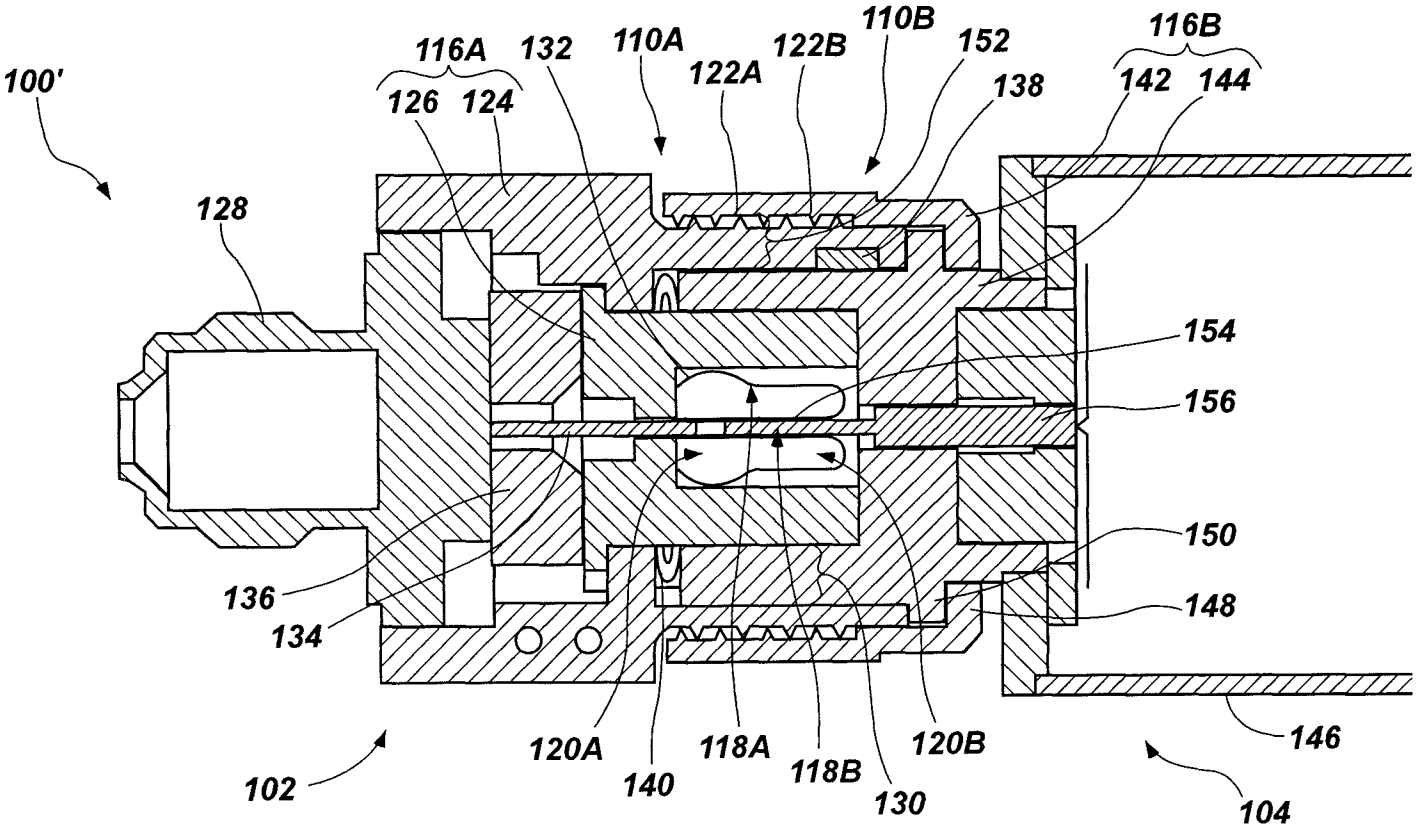
FIG. 4 is a cross-sectional view of a portion of the firing unit assembly of FIG. 3.

Referring to FIG. 4, a cross-sectional view of a portion of the firing unit assembly 100' of FIG. 3 is shown. The first housing 116A of the first mating connector 110A may be formed from a first housing member 124 and a second housing member 126 in some embodiments. In other embodiments, the first housing 116A may be a single, unitary structure. The first housing member 124 may be annular in shape, having a hollow, generally cylindrical form. The first housing member 124 may be attached to an initiator 128 of the initiation device 102, which may be configured to ignite an explosive material or other fuel when a firing pulse is received by the initiator 128. The first housing member 124 may be, for example, welded, soldered, adhered, or otherwise attached (e.g., using a snap fit, interference fit, shrink fit, etc.) to the initiator 128. The first connection portion 122A of the first mating connector 110A may be formed in the first housing member 124. For example, the first connection portion 122A may comprise an engagement feature (e.g., a threaded engagement feature, a bayonet connection feature, etc.) formed in an outer surface of the first housing member 124.

The second housing member 126 may be attached to the first housing member 124. For example, the second housing member 126 may be disposed within the annular first housing member 124, and may be welded, soldered, adhered, or otherwise attached (e.g., using a snap fit, interference fit, shrink fit, etc.) to the first housing member 124. The first and second housing members 124 and 126 may cooperatively define a space 130 (e.g., an annular space) configured to receive a portion (e.g., an annular portion) of another mating connector at least partially into the space 130. The second housing member 126 may also define the first recess 120A in which the first electrical interface 118A is at least partially disposed.

The first electrical interface 118A may comprise conductive members configured to receive a conductive structure within the conductive members and to electrically connect to the conductive structure through physical contact between the conductive materials of the conductive members and the conductive structure disposed within the conductive members. For example, the first electrical interface 118A may include one or more conductive members formed as a female spring-loaded interface. Such a female spring-loaded interface may comprise leaf springs 132 (e.g., leads) on two opposing sides of a central space into which a corresponding conductive structure (e.g., second electrical interface 118B as discussed in further detail below) may be inserted. The positioning of the individual leaf springs 132 may correspond to contacts on the conductive structure. The leaf springs 132 may deform elastically as the conductive structure is inserted between the leaf springs 132, and may press against the conductive structure to maintain contact between the leaf springs 132 and the conductive structure. The leaf springs 132 may be electrically connected to the initiator 128. For example, the leaf springs 132 may extend from a printed circuit board (PCB) 134, which may be connected to the initiator 128. In such an embodiment, a firing pulse transmitted to the leaf springs 132 may be conducted through the PCB 134 to the initiator 128. In other embodiments, the first electrical interface 118A may comprise, for example, an array of mating pins 162 (see FIG. 10), spring pins, coaxial electrical connectors, triaxial electrical connectors, single, triple, or other numbers of coaxial pin-and-socket connectors, and other configurations for electrical interfaces known in the art.

In some embodiments, a spacer 136 may separate the initiator 128 from the second housing member 126.

In some embodiments, another conductive structure (e.g., contact ring 138) may optionally be disposed in the first mating connector 110A. For example, contact ring 138 may be formed as a conductive annular member and attached to the first housing member 124. In other embodiments, the contact ring 138 may be formed in an obround, square, rectangular, or other polygonal or irregular shape, and may include gaps in a discontinuous structure. The contact ring 138 may be configured to electrically ground the first housing 116A to a housing of another mating connector. In other embodiments, a contact ring may optionally be disposed in a mating connector to which the first mating connector 110A is configured to removably connect.

In some embodiments, a packing ring 140 may optionally be disposed in the first mating connector 110A. For example, the packing ring 140 comprising a compressible annular member may be disposed in the space 130 between the first and second housing members 124 and 126 and may be configured to compress as another mating connector presses against the packing ring 140. The packing ring 140 may enable the first mating connector 110A to form an axial seal (e.g., a hermetic seal or an environmental seal) with another mating connector. In other embodiments, a packing ring may optionally be disposed in a mating connector to which the first mating connector 110A is configured to removably connect. In some embodiments, a sealing member (e.g., an O-ring) may form a radial seal in addition to, or in the alternative from, the packing ring 140. In some embodiments, redundant axial, radial, or axial and radial seals may form a seal between mating connectors.

The second housing 116B of the second mating connector 110B may be formed from a third housing member 142 and a fourth housing member 144 in some embodiments. In other embodiments, the second housing 116B may be a single, unitary structure. The third housing member 142 of the second mating connector 110B may be configured to receive at least a portion of the first mating connector 110A (e.g., a portion of the first housing member 124, a portion of the second housing member 126, or a portion of both) at least partially within the third housing member 142. For example, the third housing member 142 may comprise an annular member having an inner diameter greater than an outer diameter of the first housing member 124. The second connection portion 122B of the second mating connector 110B may be formed in the third housing member 142. For example, the second connection portion 122B may comprise an engagement feature cooperative with the engagement feature of the first connection portion 122A of the first mating connector 110A formed in an inner surface of the third housing member 142. The first housing member 124 may be inserted at least partially into the third housing member 142, and relative rotation of the first and third housing members 124 and 142 may cause their respective threaded engagements of their respective first and second connection portions 122A and 122B to threadedly engage one another. Relative rotation in an opposite direction may cause the first and second connection portions 122A and 122B to threadedly disengage from one another. In other embodiments, the engagement feature may comprise, for example, a sliding fit with flanges, clamps, screws, jack-screws, or other mating engagements that physically secure the mating connectors to one another. As a specific, non-limiting example, the engagement features may comprise D-subminiature connectors.

The fourth housing member 144 may be connected to an electronic device 146 of the electronics assembly 104, which may be configured to produce a firing signal for transmission to the initiation device 102. For example, the fourth housing member 144 may be welded, soldered, adhered, or otherwise attached (e.g., using a snap fit, interference fit, shrink fit, etc.) to the electronic device 146.

In some embodiments, the third housing member 142 may be connected to the fourth housing member 144 such that the third housing member 142 may be rotatable about the fourth housing member 144. For example, an annular protrusion 148 of the third housing member 142 extending radially inwardly may be positioned between the electronic device 146 and an annular protrusion 150 of the fourth housing member 144 extending radially outwardly. The positioning of the electronic device 146, the annular protrusion 148 of the third housing member 142, and the annular protrusion 150 of the fourth housing member 144 may prevent the third housing member 142 from separating from the fourth housing member 144. The third housing member 142 may be rotatable about the fourth housing member 144, such that rotation of the third housing member 142 may be used to engage and disengage with the first housing member 124 of the first mating connector 110A. The third housing member 142 may optionally include gripping members (e.g., planar outer surfaces defining a hexagonal shape, like a hex nut) to facilitate rotation of the third housing member 142 and connection of the second mating connector 110B to another mating connector (e.g., first mating connector 110A or third mating connector 110C (see FIG. 2)).

The fourth housing member 144 may be at least partially disposed within the third housing member 142. The third and fourth housing members 142 and 144 may cooperatively define a space 152 (e.g., an annular space) configured to receive at least a portion of the first housing member 124 at least partially into the space 152. The fourth housing member 144 may also define the second recess 120B in which the second electrical interface 118B is at least partially disposed.

The second electrical interface 118B may comprise a conductive structure configured to be at least partially inserted within the first electrical interface 118A and to electrically connect to the first electrical interface 118A through physical contact between the conductive materials of the conductive structure of the second electrical interface 118B and the conductive members of the first electrical interface 118A. For example, the second electrical interface 118B may comprise a stripline male interface. Such a stripline male interface may comprise, for example, electrically conductive contacts 154 (e.g., bond pads, leads, pins, sockets, vias, feed through vias, strips of conductive material) on opposing sides of a dielectric material. For example, the stripline male interface may comprise contacts 154 disposed on (e.g., formed on or attached to) opposing sides of a PCB 156. The PCB 156 may be electrically connected to the electronic device 146. As the stripline male interface is at least partially inserted into the female spring-loaded interface, the leaf springs 132 may establish electrical connections with the contacts 154 because of physical contact between the leaf springs 132 and the contacts 154. A firing pulse generated by the electronic device 146 may be conducted through components of the PCB 156 to the contacts 154, through the contacts 154 to the leaf springs 132, through the leaf springs 132 to the PCB 134, and through the PCB 134 to the initiator 128.

In other embodiments, the stripline male interface of the second electrical interface 118B and the female spring-loaded interface of the first electrical interface 118A may be switched. In other words, the first electrical interface 118A of the first mating connector 110A may comprise a stripline male interface and the second electrical interface 118B of the second mating connector 110B may comprise a female spring-loaded interface.

Referring to FIG. 2, the third mating connector 110C of the connection cable 106 may be configured in at least substantially the same way as the first mating connector 110A of the initiation device 102. Likewise, the fourth mating connector 110D may be configured in at least substantially the same way as the second mating connector 110B of the electronics assembly 104. A firing pulse generated by the electronics assembly 104 may be conducted through the second electrical interface 118B of the second mating connector 110B to the third electrical interface 118C of the third mating connector 110C, through the third electrical interface 118C to the stripline cable 108 of the connection cable 106, through the stripline cable 108 to the fourth electrical interface 118D of the fourth mating connector 110D, through the fourth electrical interface 118D to the first electrical interface 118A of the first mating connector 118A of the initiation device 102.

Returning to FIG. 4, the first housing member 124 of the first mating connector 110A (or of a mating connector configured in a manner at least substantially similar to the first mating connector 110A, such as, for example, the third mating connector 110C of the connection cable 106 (see FIG. 2)) may be at least partially inserted within the third housing member 142 of the second mating connector 110B (or of a mating connector configured in a manner at least substantially similar to the second mating connector 110B, such as, for example, the fourth mating connector 110D of the connection cable 106 (see FIG. 2)). As the first housing member 124 is at least partially received within the third housing member 142, one of the first housing member 124 and the third housing member 142 may be rotated relative to the other of the first housing member 124 and the third housing member 142 to removably connect the first connection portion 122A to the second connection portion 122B. For example, the first housing member 124 may be inserted within the third housing member 142, and the third housing member 142 may be rotated around the first housing member 124 to engage threads of the first and second connection portions 122A and 122B with one another.

When removably connecting the first mating connector 110A with the second mating connector 110B, the first housing member 124 may be inserted at least partially into the space 152 defined by the third and fourth housing members 142 and 144. Likewise, the fourth housing member 144 may be at least partially inserted into the space 130 defined by the first and second housing members 124 and 126. The first and second housings 116A and 116E may form a tortuous path between an exterior of the assembled firing unit assembly 100' and the first and second recesses 120A and 120B in which the first and second electrical interfaces 118A and 118B are disposed to form a seal (e.g., a hermetic seal (i.e., an airtight seal) or an environmental seal) around the first and second electrical interfaces 118A and 118B. The packing ring 140, where implemented, may ensure that a seal is formed around the first and second electrical interfaces 118A and 118B. For example, the fourth housing member 144 may abut against and at least partially compress the packing ring 140 to ensure that a seal is formed around the first and second electrical interfaces 118A and 118B. The contact ring 138 may electrically ground the first and second housings 116A and 116B to one another. For example, the contact ring 138 disposed in the first housing member 124 of the first housing 116A may contact the fourth housing member 144 of the second housing 116B as the first housing member 124 is inserted into the space 152 defined by the third and fourth housing members 142 and 144.

When removably connecting the first mating connector 110A with the second mating connector 110B, the first electrical interface 118A may electrically connect to the second electrical interface 118B. For example, the contacts 154 of the stripline male interface may be at least partially received between the leaf springs 132 of the female spring-loaded interface. Physical contact between the contacts 154 and the leaf springs 132 may electrically connect the first electrical interface 118A to the second electrical interface 118B. In other embodiments, the stripline male interface may be received between spring pins of the female spring-loaded interface.

The foregoing description of a process for connecting mating connectors referred specifically to the first and second mating connectors 110A and 110B. However, other mating connectors may be removably connected to one another using the same or substantially the same process. For example, and with reference to FIG. 2, the first mating connector 110A of the initiation device 102 may be removably connected to the fourth mating connector 110D of the connection cable 106 using the same or substantially the same process. Likewise, the second mating connector 110B of the electronics assembly 104 may be removably connected to the third mating connector 110C of the connection cable 106 using the same or substantially the same process to assemble the firing unit assembly 100 as shown in FIG. 1.

Figure 5:
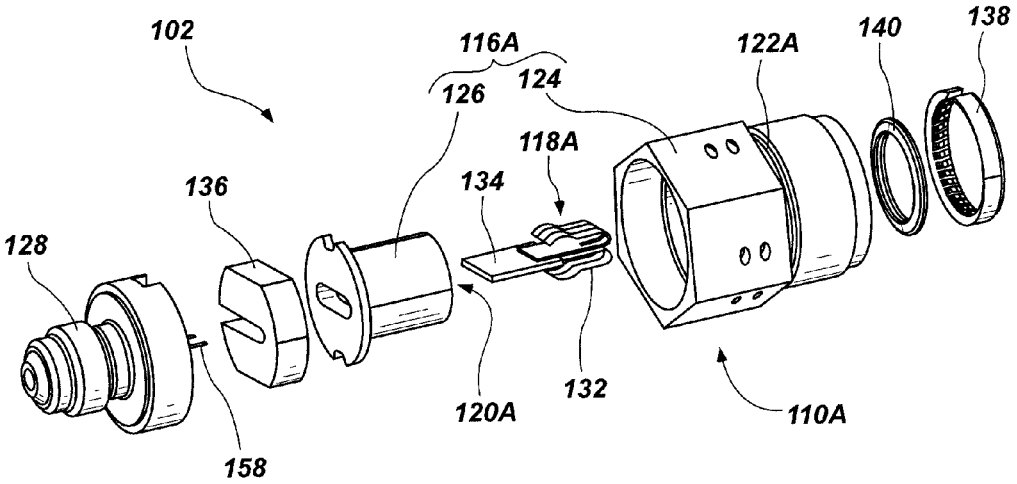
FIG. 5 is an exploded view of an initiator device for use with a firing unit assembly such as the firing unit assemblies of FIG. 1 or FIG. 3.

Referring to FIG. 5, an exploded perspective view of an initiator device 102 for use with the firing unit assemblies 100 or 100' of FIG. 1 or FIG. 3 is shown. When assembling the initiator device 102, the contact ring 138 may optionally be connected to the first housing 124. For example, the contact ring 138 may be snap fit within a recess formed in the first housing member 124. The first electrical interface 118A may be at least partially disposed within the first recess 120A. For example, the leaf springs 132 may be disposed within the first recess 120A formed in the second housing member 126 and the PCB 134 may extend through the second housing member 126. The leaf springs 132 may be at least partially formed from an electrically conductive material. In some embodiments, the leaf springs 132 may be partially coated with a dielectric material, leaving a contact area exposed for electrical connection to another electrical interface (e.g., second or fourth electrical interfaces 118B or 118D (see FIGS. 2 and 4)). Such a dielectric coating may provide a barrier to corona arcing around the first electrical interface 118A in a vacuum environment. The first housing member 124 may be attached to the second housing member 126 to form the first housing 116A. For example, the second housing member 126 may be disposed within the first housing member 124, and may be welded, soldered, adhered, or otherwise attached (e.g., using a snap fit, interference fit, shrink fit, etc.) to the first housing member 124. The packing ring 140 may optionally be disposed in the space 130 (see FIG. 4) defined by the first and second housing members 124 and 126, and may optionally be secured to one or both of the first and second housing members 124 and 126. Thus, the first mating connector 110A may be assembled. The first mating connector 110A may be attached to the initiator 128. For example, leads 158 extending from the initiator 128 may be electrically connected (e.g., soldered) to the PCB 134 extending through the second housing member 126 and the initiator 128 may be welded, soldered, adhered, or otherwise attached (e.g., using a snap fit, interference fit, shrink fit, etc.) to the first housing member 124. The spacer 136 may optionally be disposed between the initiator 128 and the second housing member 126.

Returning to FIG. 2, other mating connectors may be assembled in a manner similar to that described for the first mating connector 110A in connection with FIG. 5. For example, the third mating connector 110C may be assembled in a manner at least substantially similar to that described for the first mating connector 110A in connection with FIG. 5. The third mating connector 110C may be attached to the stripline cable 108. For example, the first end 112 of the stripline cable 108 may be electrically connected to the PCB 134 (see FIG. 5) and the stripline cable 108 may be attached to the second housing member 126, such as, for example, by solder, by an insulation overmold formed around the first end 112 and a portion of the second housing member 126, by adhesion, or other methods known in the art.

Figure 6:
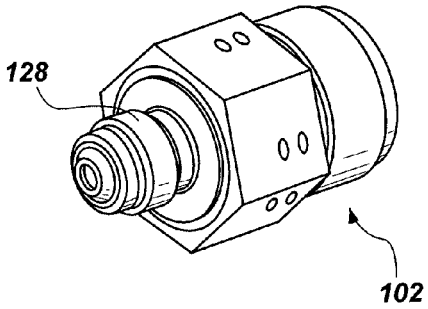
FIG. 6 is a perspective view of the initiator device of FIG. 5.
Figure 7:
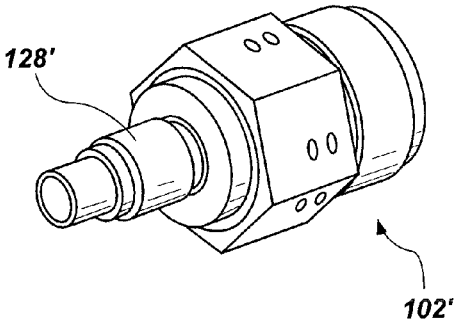
FIG. 7 is a perspective view of another embodiment of an initiator device for use with a firing unit assembly such as the firing unit assemblies of FIG. 1 or FIG. 3.

Referring to FIGS. 6 and 7, perspective views of embodiments of assembled initiator devices 102 and 102' are shown. More specifically, FIG. 6 depicts an embodiment of an initiator device 102 comprising an initiator 128 configured as an EFI. By contrast, FIG. 7 depicts an embodiment of an initiator device 102' comprising an initiator 128' configured as an EFD.

Figure 8:
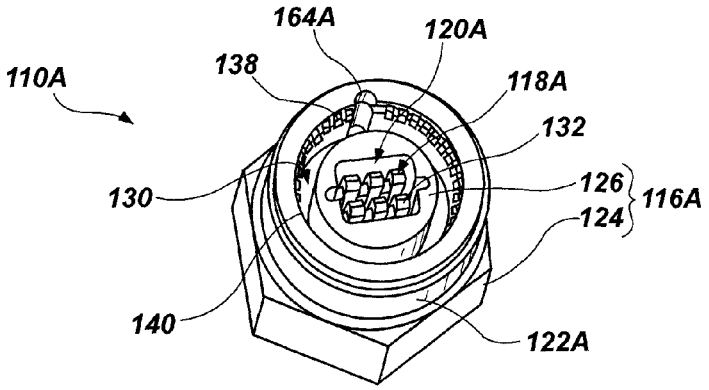
FIG. 8 is a perspective view of another embodiment a mating connector of an initiator device.

Referring FIG. 8, a perspective view of the first mating connector 110A of the initiator device 102 of FIG. 5 is shown. The female spring-loaded interface of the first electrical interface 118A may comprise a total of six leaf springs 132, three on each opposing side of the first electrical interface 118A, in some embodiments. In other embodiments, different quantities of leaf springs 132 may be employed and the leaf spring 132 or leaf springs 132 may be disposed on either side of the first electrical interface 118A. As shown in FIG. 8, the first mating connector 110A (or another mating connector configured in a manner similar to the first mating connector 110A, such as, for example, the third mating connector 110C (see FIG. 2)) may comprise a first alignment feature 164A. The first alignment feature 164A may comprise a recess configured to receive a corresponding protrusion (e.g., protrusion 164B) on another mating connector. In alternative embodiments, the first alignment feature 164A may comprise a protrusion configured for at least partial insertion into a corresponding recess on another mating connector. Such first alignment features 164A may enable orientation of mating connectors relative to one another such that a proper physical and electrical connection is formed when connecting the mating connectors.

Figure 9:
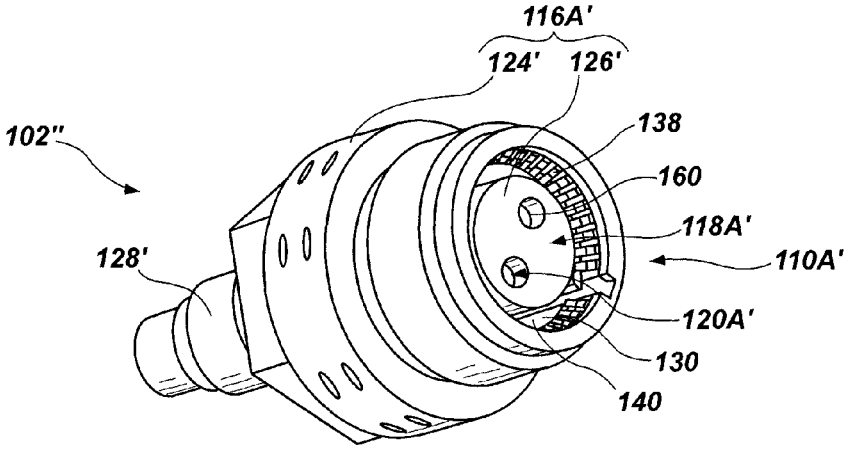
FIG. 9 is a perspective view of yet another embodiment of an initiator device.

Referring to FIG. 9, a perspective view of another embodiment of a first mating connector 110A' on an initiation device 102" is shown. The first mating connector 110A' may be somewhat similar to the first mating connector 110A described above. The first electrical interface 118A' of such a first mating connector 110A' may comprise a female socket interface. For example, the female socket interface of the first electrical interface 118A' may include sockets 160 configured to receive pins of another electrical interface of another mating connector to form an electrical connection. As a specific, nonlimiting example, the first electrical interface 118A' may include two sockets 160 configured to receiving mating pins to form an electrical connection. In other embodiments, the first electrical interface 118A' may include an array of four, six, eight, or other numbers of sockets 160.

Figure 10:
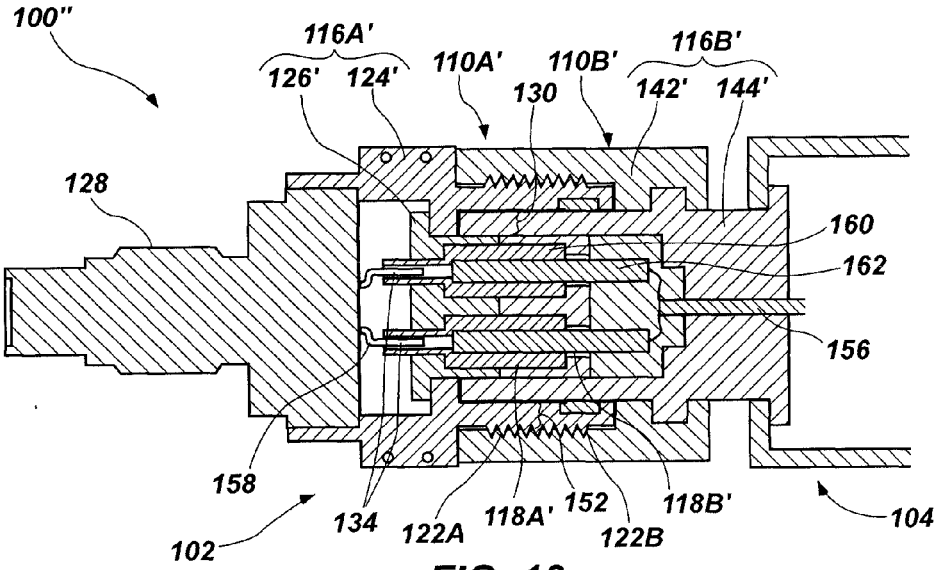
FIG. 10 is a cross-sectional view of the initiator device of FIG. 9.

Referring to FIG. 10, a cross-sectional view of a portion of another embodiment of a firing unit assembly 100" is shown. The firing unit assembly 100" may be somewhat similar to the firing unit assemblies 100, 100' of FIG. 1 and FIG. 3 as described above. The first and second electrical interfaces 118A' and 118B' may form pin-and-socket interfaces. For example, the first electrical interface 118A' may comprise sockets 160 lined with an electrically conductive material. The second electrical interface 118B' may comprise pins 162 of an electrically conductive material. An electrical connection may be formed through physical contact between the pins 162 and the electrically conductive material lining the sockets 160. In other embodiments, the electrical interfaces of mating connectors may comprise coaxial electrical connectors, triaxial electrical connectors, twinaxial electrical connectors, single, triple, or other numbers or arrays of pin-and-socket connectors, and other configurations for electrical interfaces known in the art.

Figure 11:
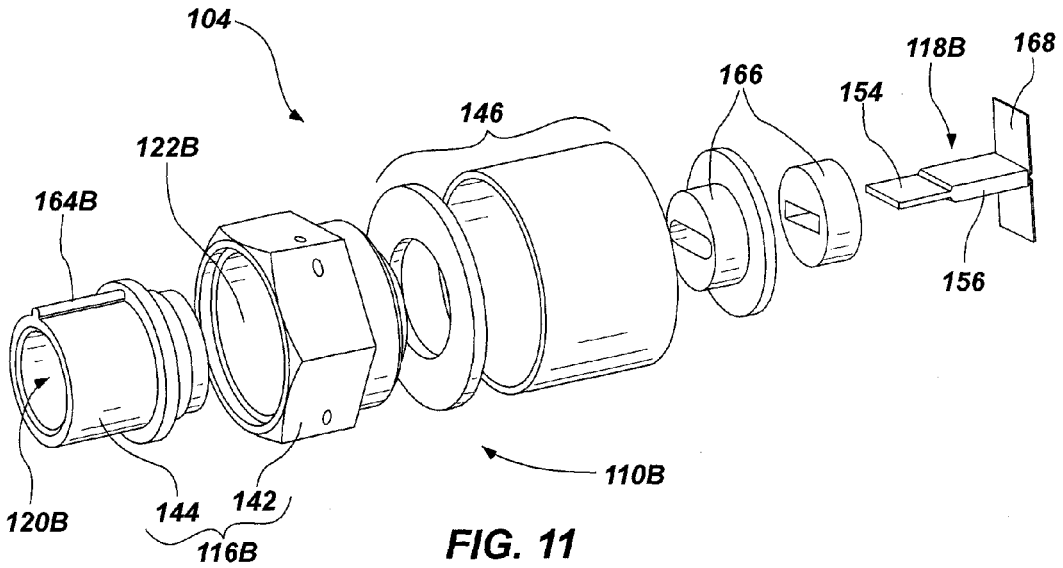
FIG. 11 is an exploded perspective view of an electronics assembly for use with a firing unit assembly such as the firing unit assemblies of FIG. 1 or FIG. 3.

Referring to FIG. 11, an exploded perspective view of an electronics assembly 104 for use with a firing unit assembly such as the firing unit assemblies 100 or 100' of FIG. 1 or FIG. 3 is shown. When assembling the electronics assembly 104, the stripline male interface of the second electrical interface 118B may optionally be inserted through a spacer 166 or spacers 166 to ensure that the second electrical interface 118B is disposed within the second recess 120B defined by the fourth housing member 144 when the electronics assembly 104 is fully assembled. As shown in FIG. 11, the stripline male interface may comprise a "T-shaped" or a "Y-shaped" profile, with the contacts 154 and the PCB 156 defining a flat central member and flanges 168 extending outwardly from the flat central member. Such flanges 168 may prevent the stripline male interface from passing entirely through the spacers 166 and other structures through which the stripline male interface may extend. The stripline male interface of the second electrical interface 118B and the optional spacers 166 may be placed at least partially within the electronic device 146 and the contacts 154 of the stripline male interface may extend out from the electronic device 146. The PCB 156 of the stripline male interface may be electrically connected to a component or components of the electronic device 146 such that a firing signal generated by the electronic device 146 is conducted through the PCB 156 to the contacts 154. At least the contacts 154 of the stripline male interface may be inserted into the third housing member 142. The fourth housing member 144 may be disposed within the third housing member 142 such that the contacts 154 of the stripline male interface are disposed within the second recess 120B defined by the third housing member 142, a space 152 (see FIG. 4) is defined between the third and fourth housing members 142 and 144, and the fourth housing member 144 is rotatable around the third housing member 142. The fourth housing member 144 may be attached to the electronic device 146.

Returning to FIG. 2, other mating connectors may be assembled in a manner similar to that described for the second mating connector 110E in connection with FIG. 11. For example, the fourth mating connector 110D may be assembled in a manner at least substantially similar to that described for the second mating connector 110B in connection with FIG. 11. The fourth mating connector 110D may be attached to the stripline cable 108. For example, the second, opposing end 114 of the stripline cable 108 may be electrically connected to the PCB 156 (see FIG. 11) and the stripline cable 108 may be attached to the fourth housing member 144, such as, for example, by solder, by an insulation overmold formed around the second, opposing end 114 and a portion of the fourth housing member 144, by adhesion, or other methods known in the art.

Figure 12:
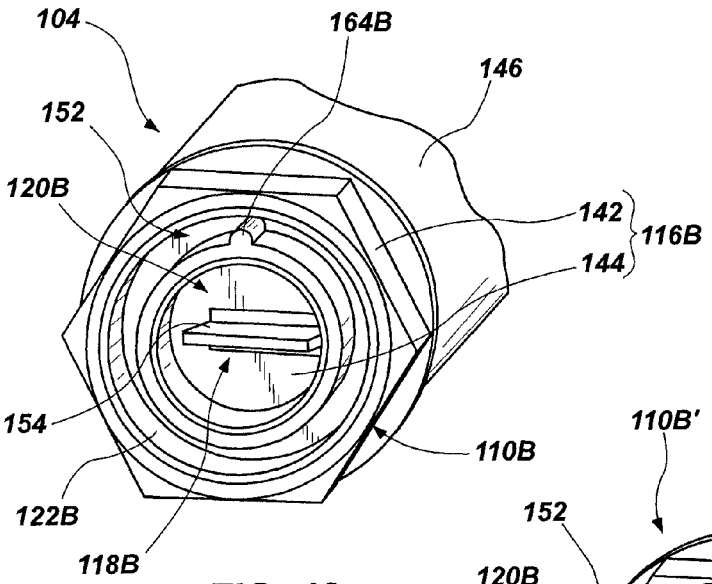
FIG. 12 is a perspective view of a mating connector of the electronics assembly of FIG. 11.

Referring to FIG. 12, a perspective view of the second mating connector 110B of the electronics assembly 104 of FIG. 11 is shown. The stripline male interface of the electrical interface 118B of the second mating connector 110B may have a rectangular shape configured for receipt within a female spring-loaded interface. The contacts 154 of the stripline male interface may comprise conductive material disposed on upper and lower opposing sides of the stripline male interface. For example, the contacts 154 may comprise a total of six strips of conductive material, three on each opposing side, configured for connection to corresponding leaf springs 132 (see FIG. 4) of another mating connector (e.g., one of the first or third mating connectors 110A or 110C). In other embodiments, the contacts 154 may comprise a single strip of conductive material on each side of the stripline male interface, other numbers of strips of conductive material (e.g., two, four, etc.) on each side of the stripline male interface, bumps, columns, bond pads, and other conductive structures known in the art.

Figure 13:
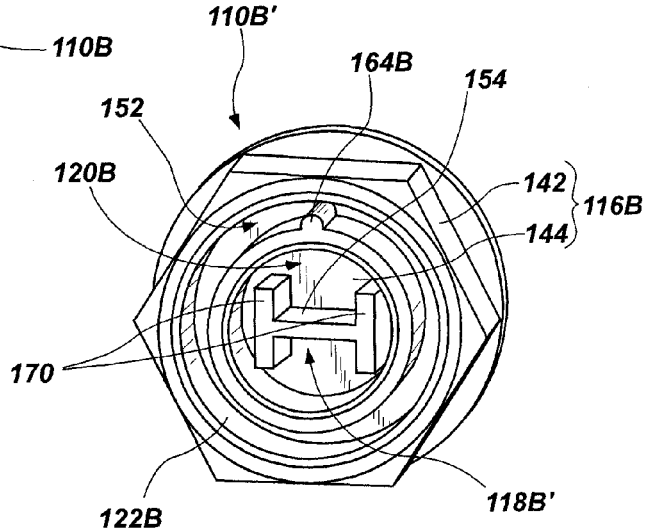
FIG. 13 is a perspective view of another embodiment of a electronics assembly including a mating connector.

Referring to FIG. 13, a perspective view of another embodiment of a second mating connector 110B' is shown. The mating connector 110B' may be somewhat similar to the first mating connector 110B described above. The stripline male interface of the electrical interface 118B' may include a pair of dielectric rails 170 of flanking the rectangular portion of the stripline male interface on which the contacts 154 are disposed. In other words, the stripline male interface may be generally "H-shaped." The pair of dielectric rails 170 may be spaced to receive the leaf springs 132 (see FIG. 4) of another mating connector (e.g., one of the first or third mating connectors 110A or 110C) between the dielectric rails 170. In such an embodiment, the pair of dielectric rails 170 may be configured to capture the leaf springs 132 (see FIG. 4) between the dielectric rails 170. Such dielectric rails 170 may provide a barrier to corona arcing around the sides of the second electrical interface 118B' in a vacuum environment.

Figure 14:
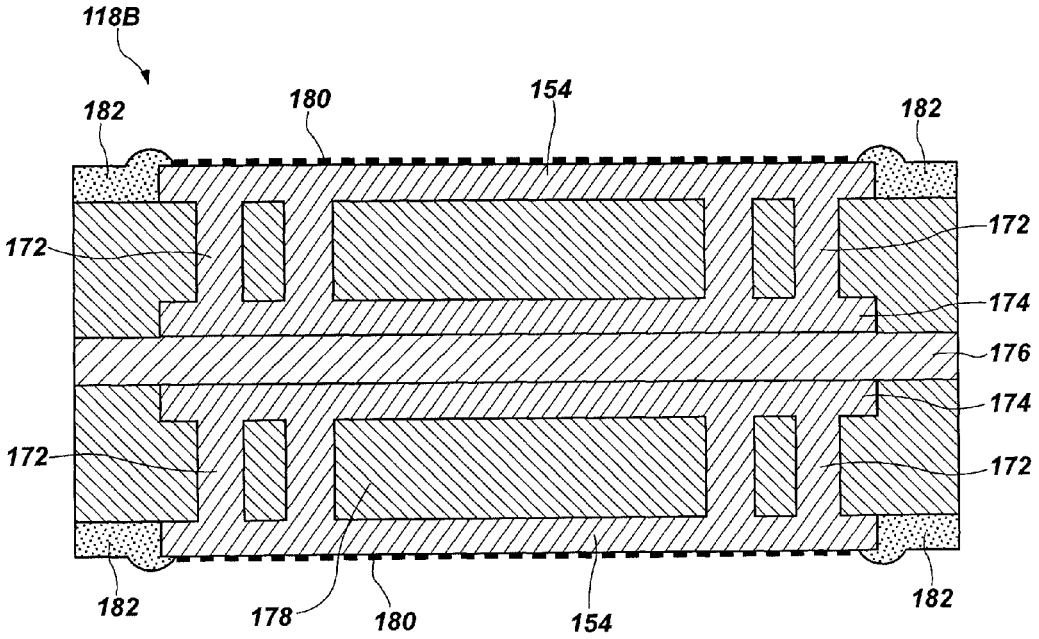
FIGS. 14 through 16 are cross-sectional schematic views of electrical interfaces for use with the firing unit assembly of FIG. 1.
Figure 15:
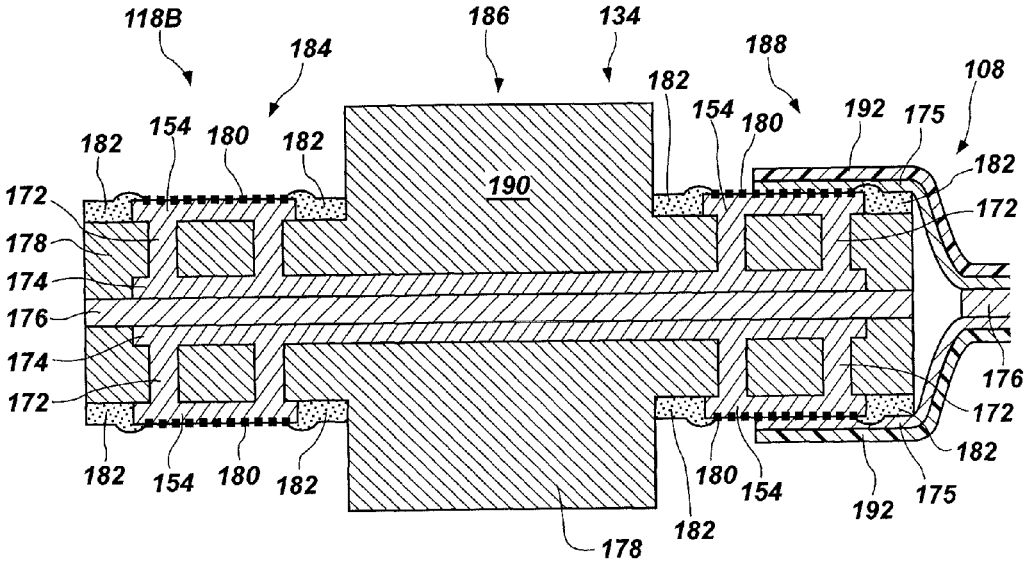
Figure 16:
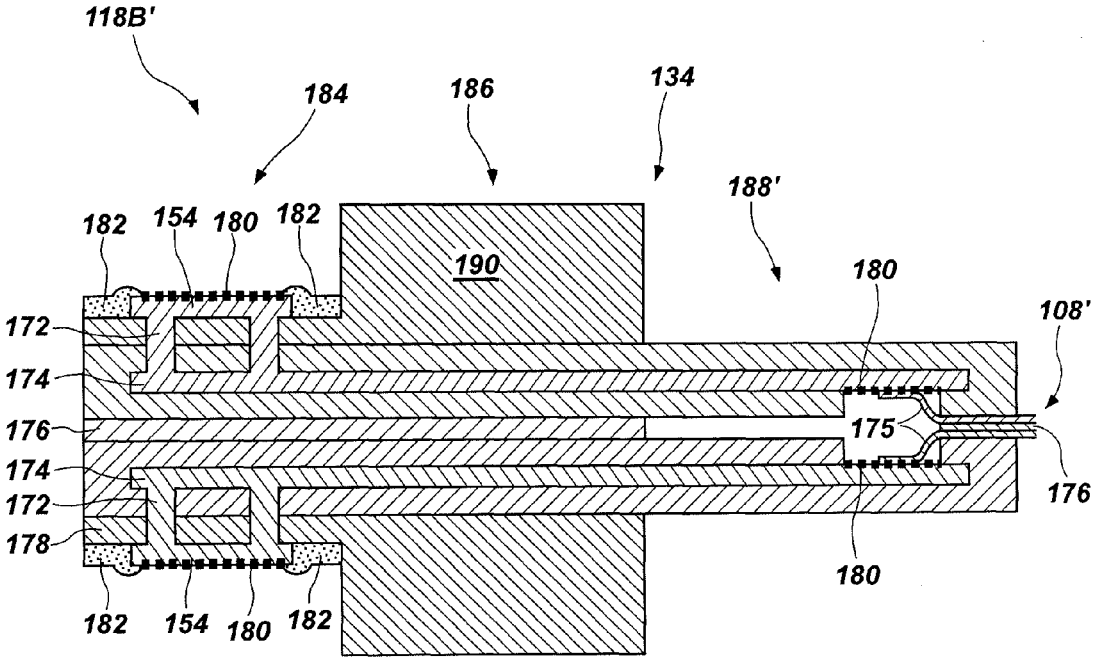

Referring to FIGS. 14 through 16, cross-sectional schematic views of second electrical interfaces 118B for use with the firing unit assembly of FIG. 1 are shown. Referring specifically to FIG. 14, a cross-sectional view of the second electrical interface 118B taken in a plane perpendicular to a direction of insertion of the second electrical interface 118B into the first or third electrical interfaces 118A or 118C (see FIG. 2) is shown. The contacts 154 of the stripline male interface of the second electrical interface 118B may comprise a conductive material (e.g., a conductive layer or a conductive strip) disposed on opposing sides of the second electrical interface 118B. Conductive vias 172 may extend from the contacts 154 to inner conductors 174. The inner conductors 174 may be separated by a central insulator 176. The contacts 154, the vias 172, and the inner conductors 174 may be at least partially formed from an electrically conductive material, such as, for example, copper, gold, palladium, rhodium, silver, and alloys and combinations (e.g., plated layers) thereof. The central insulator 176 may comprise an electrically insulating material, such as, for example, polyethylene, polyimide, polyvinyl chloride (PVC), KAPTON®, and other electrically insulating (e.g., dielectric) materials known in the art. Spaces between the contacts 154, the vias 172, and the inner conductors 174 may be filled with a filler material 178. The filler material 178 may comprise an electrically insulating material, such as, for example, polyethylene, polyimide, polyvinyl chloride (PVC), fiberglass, KAPTON®, and other electrically insulating materials known in the art.

An optional connection surface coating 180 may be disposed on surfaces of the contacts 154 configured for electrical connection to another electrical interface (e.g., to leaf springs 132 of the first or third electrical interfaces 118A or 118C (see FIG. 4)). For example, the optional connection surface coating 180 may comprise a layer of gold, a layer of tin-lead solder, a layer of palladium, a layer of rhodium, a layer of silver, or multiple layers of such metals or alloys thereof. As a specific, nonlimiting example, the optional connection surface coating 180 may comprise a layer of tin-lead solder deposited by hot air solder leveling (HASL). Such an optional connection surface coating 180 may facilitate electrical connection of other components (e.g., leaf springs 132 of the first or third electrical interfaces 118A or 118C (see FIG. 4)) to the contacts 154. The contacts 154 may optionally be flanked or surrounded by protective material 182. For example, the protective material 182 may comprise tin-lead solder covering corners and edges of the contacts 154. By covering corners and edges of the contacts 154, the protective material 182 may reduce or prevent concentrations of electrical energy at the corners and edges of the contacts 154, which may otherwise cause arcing of electrical energy.

Referring to FIG. 15, a cross-sectional schematic view of the second electrical interface 118B taken in a plane parallel to a direction of insertion of the second electrical interface 118B into the first or third electrical interfaces 118A or 118C (see FIG. 2) is shown. The second electrical interface 118B may comprise a first end 184 configured for connection to another electrical interface (e.g., to first or third electrical interfaces 118A or 118C), an intermediate portion 186, and a second end 188 configured for connection to another device or structure. The intermediate portion 186 and the second end 188 may comprise the PCB 134. The intermediate portion 186 may comprise a support portion 190. The support portion 190 may comprise, for example, an enlarged section of the filler material 178, which may provide structural support to the second electrical interface 118B and may be configured for attachment to another device or structure. For example, the support portion 190 may be adhered, snap-fit, or interference fit to the second housing member 126 or to the fourth housing member 144 of any of the first, second, third, or fourth mating connectors 110A, 110B, 110C, or 110D (see FIG. 2). The second end 188 may be configured in a manner similar to the first end 184. The central insulator 176, the inner conductors 174, and the filler material 178 may extend from the first end 184, through the intermediate portion 186, to the second end 188. The second end 188 may be connected to another portion of a firing unit assembly (e.g., the stripline cable 108 of the connection cable 106, the initiation device 102, or the electronic device 146). For example, the second end 188 may be connected to a stripline cable 108. The stripline cable 108 may be the stripline cable 108 of the connection cable 106, may provide connection to the initiator 128 of the initiation device 102, or may provide connection to electrical components or devices of the electronic device 146 of the electronics assembly 104 (see FIGS. 2, 4, and 11). The stripline cable 108 may comprise, for example, a pair of outer conductors 175, a central insulator 176 between the outer conductors 175, and an optional outer insulator 192 covering the outer conductors 175. At least a portion of the outer conductors 175 may be exposed for connection to the contacts 154 at the second end 188. For example, the outer conductors 175 may extend beyond the central insulator 176 onto the contacts 154, where they may be soldered, brazed, clamped, or otherwise connected to the contacts 154.

Referring to FIG. 16, a cross-sectional schematic view of another embodiment of the second electrical interface 118B' taken in a plane parallel to a direction of insertion of the second electrical interface 118B' into the first or third electrical interfaces 118A or 118C (see FIG. 2) is shown. The second electrical interface 118B' may be somewhat similar to the second electrical interface 118B described above. The second end 188' configured for connection to another device or structure may be configured in a manner different from the first end 184 configured for connection to another electrical interface (e.g., to first or third electrical interfaces 118A or 118C). For example, the inner conductors 174 of the second electrical interface 118B' may be exposed at an inner portion of the second end 188'. A gap in the central insulator 176 and the filler material 178 may enable access to the inner portions of the inner conductors 174, which may optionally be covered with a connection surface coating 180. The second end 188' may be connected to another portion of a firing unit assembly (e.g., the stripline cable 108 of the connection cable 106, the initiation device 102, or the electronic device 146). For example, a stripline cable 108' may be physically and electrically connected to the inner conductors 174 of the second electrical interface 118B'. The stripline cable 108' may be the stripline cable 108 of the connection cable 106, may provide connection to the initiator 128 of the initiation device 102, or may provide connection to electrical components or devices of the electronic device 146 of the electronics assembly 104 (see FIGS. 2, 4, and 11). The stripline cable 108' may comprise, for example, a pair of outer conductors 175 and a central insulator 176 between the outer conductors 175. At least a portion of the outer conductors 175 may be exposed for connection to the inner conductors 174 of the second electrical interface 118B' at the second end 188'. For example, the outer conductors 175 may extend beyond the central insulator 176 onto the connection surface coating 180, where they may be soldered, brazed, or clamped to the inner conductors 174 of the second electrical interface 118B'.

Although the foregoing description of FIGS. 14 through 16 have referred specifically to the second electrical interface 118B or 118B', the fourth electrical interface 118D may be configured in a manner at least substantially similar to the second electrical interface 118B or 118B'. Furthermore, the first and third interfaces 118A and 118C may be configured in a manner at least substantially similar to the second electrical interface 118B or 118B' with the leaf springs 132 (see FIG. 4) physically and electrically connected to the contacts 154 (e.g., by soldering, brazing, or welding).

Figure 17:
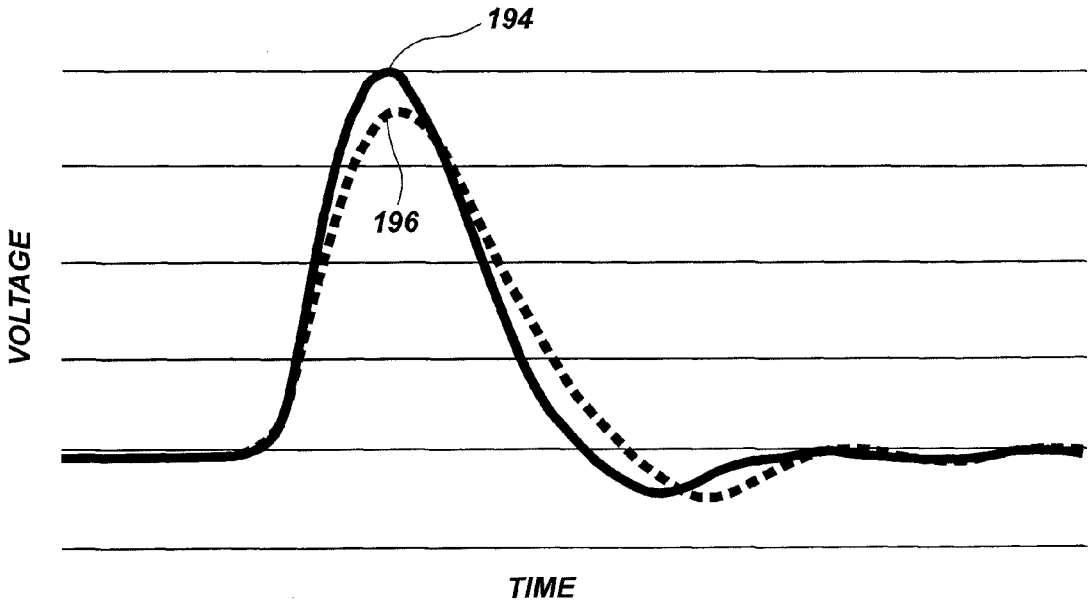
FIG. 17 is a graph of firing signals transmitted through the firing unit assemblies of FIGS. 1 and 3.

Referring to FIG. 17, a graph of firing signals transmitted through the firing unit assemblies 100 and 100' of FIGS. 1 and 3, respectively, is shown. The same firing signal was generated by the electronics assembly 104 (see FIGS. 1 and 3), and was transmitted through the various components to the initiation device 102 (see FIGS. 1 and 3). The firing signal may comprise, for example, a very high-current, high-voltage, fast-rise electrical pulse configured to initiate the initiation device 102. A first measured firing signal 194 was transmitted directly from the electronics assembly 104 to the initiation device 102, configured as the firing unit assembly 100' shown in FIG. 3. A second measured firing signal 196 was transmitted from the electronics assembly 104, through the connection cable 106, to the initiation device 102, configured as the firing unit assembly 100 shown in FIG. 1. As shown in FIG. 17, the second measured firing signal 196 did not experience significant degradation as compared to the first measured firing signal 194 despite traveling a greater distance and through a greater number of electrical connections. In other words, both the first and second measured firing signals 194 and 196 were of sufficiently high voltage and current and exhibited a sufficiently fast rise to initiate the initiation device 102 (see FIGS. 1 and 3). Low impedance of electrical transmission media of the connection cable 106 may enable the firing signal to travel such a relatively greater distance and through such a relatively greater number of electrical connections without significant degradation. For example, an impedance of the stripline cable 108 of the connection cable 106 may have an inductance of 50 nH or less.

An initiation device 102 that is separable from the electronics assembly 104 may be desirable as such a configuration enables the initiation device 102 to be safely and easily removed from the electronics assembly 104. Such separation enables safe handling of the separated firing unit assembly 100, 100', or 100" and further enables testing of the components of the firing unit assembly 100, 100', or 100".

While the initiator modules and munitions control systems have been described herein with general reference to military applications, it is noted that initiator modules and munitions control systems may be utilized in other applications such as, for example, mining and drilling operations and demolition.

While certain illustrative embodiments have been described in connection with the figures, those of ordinary skill in the art will recognize and appreciate that embodiments of the disclosure are not limited to those embodiments explicitly shown and described herein. Rather, many additions, deletions, and modifications to the embodiments described herein may be made without departing from the scope of embodiments of the disclosure as hereinafter claimed, including legal equivalents. In addition, features from one embodiment may be combined with features of another embodiment while still being encompassed within the scope of embodiments of the disclosure as contemplated by the inventor.

What is claimed is:

1. A firing unit assembly, comprising:
- a connection cable comprising:
  - a first mating connector configured for removable connection to an initiation device at a first end;
  - a second mating connector configured for removable connection to an electronics assembly at a second, opposing end; and
  - a stripline cable coupled to the first mating connector at the first end and coupled to the second mating connector at the second, opposing end, the stripline cable electrically connecting the first mating connector to the second mating connector.

2. The firing unit assembly of claim 1, wherein the stripline cable is configured to transmit a firing pulse without significant degradation of the firing pulse.

3. The firing unit assembly of claim 2, wherein an inductance of the stripline cable is 50 nH or less.

4. The firing unit assembly of claim 1, wherein a length of the stripline cable is between 2 inches (5.08 cm) and 36 inches (91.44 cm).

5. The firing unit assembly of claim 1, wherein one of the first mating connector and the second mating connector comprises a stripline male interface and the other of the first mating connector and the second mating connector comprises a female spring-loaded interface configured to receive the stripline male interface at least partially into the female spring-loaded interface to form an electrical connection.

6. The firing unit assembly of claim 5, wherein a pair of dielectric rails flanks the stripline male interface and is configured to receive the female spring-loaded interface between the pair of dielectric rails.

7. The firing unit assembly of claim 1, further comprising a contact ring disposed in at least one of the first mating connector and the second mating connector configured to ground a housing of the at least one of the first mating connector and the second mating connector to one of the an initiation device and the electronics assembly.

8. The firing unit assembly of claim 1, further comprising:
- an initiation device configured to ignite a material; and
- an electronics assembly configured to transmit a firing pulse to the initiation device, wherein the first mating connector is removably connected to the initiation device and the second mating connector is removably connected to the electronics assembly.

9. The firing unit assembly of claim 1, wherein the first mating connector comprises:
- a first housing comprising:
  - a first housing member having an interior surface thereof at least partially defining a first interface recess;
  - a second housing member at least partially surrounding the first housing member, the first housing member and the second housing member defining an annular recess therebetween; and
  - a first electrical interface disposed in the first interface recess of the first housing member; and wherein the second mating connector comprises:
- a second housing; and
- a second electrical interface disposed in a second interface recess at least partially defined by an interior surface of at least a portion of the second housing.

10. The firing unit assembly of claim 9, wherein an outer portion of the second housing and the first housing member of the first housing comprise complementary engagement features configured to retain the first mating connector and the second mating connector in cooperative engagement.

11. A method of coupling the firing unit assembly of claim 1 with the connection cable, comprising:
- coupling a first mating connector of the initiation device configured to ignite an explosive material to the first mating connector of the connection cable; and
- coupling a second mating connector of the electronics assembly configured to transmit a firing pulse to the initiation device to the second mating connector of the connection cable.

12. A firing unit assembly, comprising:
- an initiation device configured to ignite a material;
- an electronics assembly configured to transmit a firing pulse to the initiation device;
- a connection cable comprising:
  - a first mating connector removably connected to one of the initiation device and the electronics assembly at a first end of the connection cable;
  - a second mating connector removably connected to the other of the initiation device and the electronics assembly at a second, opposing end of the connection cable; and
  - a stripline cable extending between and electrically connecting the first mating connector to the second mating connector.

13. The firing unit assembly of claim 12, wherein a portion of a housing of the first mating connector at least partially surrounding an electrical connector disposed in the first mating connector is received within a portion of the one of the initiation device and the electronics assembly when the second mating connector is coupled to the one of the initiation device and the electronics assembly.

14. The firing unit assembly of claim 13, wherein a portion of a housing of the second mating connector at least partially surrounding another electrical connector disposed in the second mating connector is received within a portion of the other of the initiation device and the electronics assembly when the second mating connector is coupled to the other of the initiation device and the electronics assembly.

15. The firing unit assembly of claim 12, wherein the first mating connector comprises:

a first housing comprising:

a first housing member having an interior surface thereof at least partially defining a first interface recess;

a second housing member at least partially surrounding the first housing member, the first housing member and the second housing member defining an annular recess therebetween; and a first electrical interface disposed in the first interface recess of the first housing member; and wherein the second mating connector comprises:

a second housing; and a second electrical interface disposed in a second interface recess at least partially defined by an interior surface of a portion of the second housing, wherein the portion of the second housing at least partially defining the second interface recess is received within the annular recess of the first housing when the first mating connector and the second mating connector are cooperatively engaged.

16. The firing unit assembly of claim 15, wherein the second housing further comprises an outer member, the outer member at least partially surrounding the portion of the second housing at least partially defining the second interface recess and defines a substantially annular recess between the outer member and the portion of the second housing at least partially defining the second interface recess, the substantially annular recess receiving the first housing member of the first housing when the first mating connector and the second mating connector are cooperatively engaged.

17. A firing unit assembly, comprising:

an initiation device configured to ignite a material;

an electronics assembly configured to transmit a firing pulse to the initiation device; and a connection cable comprising:

a first mating connector removably connected to a first cooperative mating connector of the initiation device at a first end of the connection cable to form a seal between the first mating connector and the first cooperative mating connector of the initiation device;

a second mating connector removably connected to a second cooperative mating connector of the electronics assembly at a second, opposing end of the connection cable to form a seal between the second mating connector and the second cooperative mating connector of the electronics assembly; and a cable separate from the initiation device, a first end of the cable coupled to the first mating connector and a second end of the cable coupled to the second mating connector, the cable extending between and electrically connecting the first mating connector to the second mating connector.

18. The firing unit assembly of claim 17, wherein the cable comprises a stripline cable having an inductance of 50 nH or less.

19. The firing unit assembly of claim 17, wherein the first mating connector comprises:

a first housing comprising:

a first housing member having an interior surface thereof at least partially defining a first interface recess;

a second housing member at least partially surrounding the first housing member, the first housing member and the second housing member defining an annular recess therebetween; and a first electrical interface disposed in the first interface recess of the first housing member; and wherein the second mating connector comprises:

a second housing; and a second electrical interface disposed in a second interface recess at least partially defined by an interior surface of at least a portion of the second housing.

20. The firing unit assembly of claim 19, wherein an electric interface of the initiation device is coupled to the first electrical interface of the first mating connector within the first interface recess of the first housing member, and wherein an electric interface of the electronics assembly is coupled to the second electrical interface of the second mating connector within the second interface recess of the second housing member.

* * * * *